US007285101B2

(12) United States Patent
Tumey

(10) Patent No.: US 7,285,101 B2
(45) **Date of Patent: *Oct. 23, 2007**

(54) VIBRATING TRANSDUCER WITH PROVISION FOR EASILY DIFFERENTIATED MULTIPLE TACTILE STIMULATIONS

(75) Inventor: David M. Tumey, Crestview, FL (US)

(73) Assignee: Solutions for Thought, LLC, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/138,753

(22) Filed: May 26, 2005

(65) Prior Publication Data

US 2006/0270954 A1 Nov. 30, 2006

(51) Int. Cl.
*A61H 1/00* (2006.01)

(52) U.S. Cl. ..... 601/46; 601/70

(58) Field of Classification Search ..... 601/28–31, 601/46, 48–51, 53–54, 70, 72, 78–80, 82, 601/86, 87, 90, 56, 58
See application file for complete search history.

(56) References Cited

U.S. PATENT DOCUMENTS

| | | | | |
|---|---|---|---|---|
| 1,425,523 | A | 8/1922 | Hammond, Jr. | |
| 3,467,959 | A | 9/1969 | Zazofsky | |
| 3,595,122 | A | 7/1971 | Brediceanu | |
| 3,991,648 | A | 11/1976 | Karpowicz | |
| D249,936 | S | 10/1978 | Ishida | |
| 4,462,297 | A | 7/1984 | Dill et al. | |
| 4,559,929 | A | 12/1985 | Hseu | |
| 4,570,616 | A | 2/1986 | Kunz et al. | |
| 5,054,361 | A | 10/1991 | Usa | |
| 5,471,695 | A | 12/1995 | Aiyar | |
| 5,515,764 | A | 5/1996 | Rosen | |
| 5,581,484 | A | 12/1996 | Prince | |
| 5,584,797 | A * | 12/1996 | Yoo | 601/56 |
| 5,726,361 | A * | 3/1998 | Ogawa | 73/663 |
| 5,935,089 | A * | 8/1999 | Shimizu | 601/111 |
| 5,959,230 | A | 9/1999 | Fulford | |
| 6,040,517 | A | 3/2000 | Sakamoto | |
| 6,102,875 | A | 8/2000 | Jones | |
| 6,217,533 | B1 | 4/2001 | McCambridge | |

(Continued)

FOREIGN PATENT DOCUMENTS

| | | |
|---|---|---|
| DE | 3243428 | 5/1984 |

(Continued)

OTHER PUBLICATIONS

A DVD video (d. Jul. 29, 2003) of Parson' classroom test of prototype w/ mixed student population, incl. partially deaf and borderline autistic children.

*Primary Examiner*—Michael A. Brown
(74) *Attorney, Agent, or Firm*—Gunn & Lee, P.C.

(57) ABSTRACT

A vibrating transducer includes a rigid housing; an electric motor enclosed within the rigid housing and having attached thereto an eccentric weight; and wherein the electric motor is supported within the rigid housing by a flexible motor mount. The rigid housing is preferably a cylindrically shaped tube. The flexible motor mount may be formed of a foam cushion wrapped substantially about the electric motor. A driver circuit, which may include may include a current amplifier or timing sub-circuits, may be provided for facilitating operation of the electric motor.

16 Claims, 11 Drawing Sheets

U.S. PATENT DOCUMENTS

| | | | | |
|---|---|---|---|---|
| 6,432,072 | B1 | 8/2002 | Harris et al. | |
| 6,461,377 | B1 | 10/2002 | An | |
| 6,653,545 | B2 | 11/2003 | Redmann et al. | |
| 6,714,123 | B1 | 3/2004 | Hideki et al. | |
| D488,078 | S | 4/2004 | Nakakjima et al. | |
| 6,737,572 | B1 | 5/2004 | Jameson et al. | |
| 6,774,297 | B1 | 8/2004 | Lee | |
| 6,850,150 | B1 | 2/2005 | Ronkainen | |
| 6,850,782 | B2 | 2/2005 | Bright et al. | |
| 2002/0143321 | A1* | 10/2002 | Shibata | 606/1 |
| 2002/0149561 | A1 | 10/2002 | Fukumoto et al. | |
| 2002/0165921 | A1 | 11/2002 | Sapieyevski | |
| 2003/0003976 | A1 | 1/2003 | Mura | |
| 2003/0024375 | A1 | 2/2003 | Sitrick | |
| 2003/0131416 | A1* | 7/2003 | Lee | 5/652 |
| 2003/0236101 | A1 | 12/2003 | Kemppinen | |
| 2004/0067780 | A1 | 4/2004 | Eiden | |
| 2004/0079220 | A1 | 4/2004 | Yagi | |
| 2004/0099132 | A1 | 5/2004 | Parsons | |
| 2004/0100366 | A1 | 5/2004 | Parsons | |
| 2004/0168565 | A1 | 9/2004 | Nagao et al. | |
| 2004/0255756 | A1 | 12/2004 | Fumiyoshi | |
| 2005/0064912 | A1 | 3/2005 | Yang et al. | |
| 2005/0275508 | A1 | 12/2005 | Orr et al. | |

FOREIGN PATENT DOCUMENTS

| | | |
|---|---|---|
| EP | 1 523 163 | 4/2005 |
| EP | 1 600 907 | 11/2005 |
| JP | 58113779 | 7/1983 |
| JP | 10 248192 | 9/1998 |
| JP | 2001154672 | 6/2001 |
| JP | 2001 259134 | 9/2001 |
| JP | 2002261637 | 9/2002 |
| JP | 2003 145049 | 5/2003 |
| JP | 2004 113944 | 4/2004 |
| JP | 2004205483 | 7/2004 |
| JP | 2004317404 | 11/2004 |
| WO | WO 03/052528 | 6/2003 |
| WO | WO 03/062930 | 7/2003 |
| WO | WO 03/105313 | 12/2003 |

* cited by examiner

VIBRATING TRANSDUCER WITH PROVISION FOR EASILY DIFFERENTIATED MULTIPLE TACTILE STIMULATIONS

FIELD OF THE INVENTION

The present invention relates to tactile stimulation. More particularly, the invention relates to a method and apparatus for producing multiple tactile stimulations that are easily differentiated one from one or more others.

BACKGROUND OF THE INVENTION

Vibrating transducers comprising eccentric weights thrown into motion with electric motors are commonplace components in pagers, cellular telephones and the like. Typically, these types of transducers are utilized to produce a tactile stimulation indicative of the occurrence of some event such as, for example, an incoming page or telephone call. Applicant has recognized, however, that multiple tactile stimulations, if readily differentiable, may be usefully employed for the indication of one of a plurality of occurrences.

Unfortunately, the vibrating transducers of the prior art are not readily susceptible to the generation of readily distinguishable multiple tactile stimulations, especially in applications requiring short durations of stimulation. Recognizing this deficiency, Applicant has a primary object of the present invention improved upon the vibrating transducers of the prior art by developing a vibrating transducer capable of delivering a high energy level in a short time duration, thereby enabling the vibrating transducer to produce easily differentiated, multiple tactile stimulations. As a further object of the present invention, Applicant has developed such a vibrating transducer that is also extremely compact and therefore readily adaptable to a wide variety of applications. Still further, it is an object of the present invention to produce such a vibrating transducer that may be readily and economically manufactured.

SUMMARY OF THE INVENTION

In accordance with the foregoing objects, the present invention—a vibrating transducer for producing multiple, readily differentiable tactile stimulations—generally comprises a rigid housing; an electric motor enclosed within the rigid housing and having attached thereto an eccentric weight; and wherein the electric motor is supported within the rigid housing by a flexible motor mount. In the preferred embodiment of the present invention, the rigid housing comprises a generally cylindrically shaped tube.

The flexible motor mount may be formed of a cushion, which may be made from foam material or the like. In at least one embodiment of the present invention, the cushion is wrapped substantially about the electric motor, centering the electric motor within the cylindrically shaped tube forming the rigid housing. In order to facilitate manufacture of the vibrating transducer of the present invention, the cushion may be wrapped by a securing sheet such as, for example, a thin paper wrapping, a length of adhesive tape or the like.

In a further embodiment of the vibrating transducer of the present invention, a driver circuit may be provided for facilitating operation of the electric motor. The driver circuit may include a current amplifier, a plurality of timing sub-circuits (such as may comprise monostable multivibrators) or a combination thereof. Preferably, the timing sub-circuits are each adapted to operate the electric motor for a distinct period of time.

Each timing sub-circuit is preferably activated by a trigger signal, which may be derived from a single input signal. In at least one embodiment of the present invention, the trigger signals are differentiated by filtering of the input signal. A signal generator may be provided for producing input signal, which may comprise a pulse train. Preferably, the pulse train comprises pulses of at least two distinct electrical characteristics such as, for example, differing time durations.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein:

FIGS. 8A and 8B show, in voltage time plots, typical signals generated by an electronic metronome for divisional and downbeats, respectively, or by telegraph devices for dashes and dots, respectively, or the like;

FIG. 9A shows, in a voltage time plot, the signals of FIGS. 8A and 8B after being passed in a pattern through an envelope detector, as implemented in the design of FIG. 7A.

FIGS. 11A and 11B show, in voltage time plots, output signals from first and second monostable multivibrator, or "one-shot," circuits, as implemented in the design of FIG. 7A, the output from the first being the result of inputting the signal of FIG. 8A to the circuit of FIG. 7A and the output from the second being the result of inputting the signal of FIG. 8B to the circuit of FIG. 7A, whereby the first is used to drive the vibrating transducer of FIG. 1 to produce a tactile stimulation easily recognized as a divisional beat, dash or the like and the second is utilized to drive the vibrating transducer of FIG. 1 to produce a tactile stimulation easily recognized as a downbeat, dot or the like.

DETAILED DESCRIPTION OF THE PREFERRED EMBODIMENT

Figure 1:
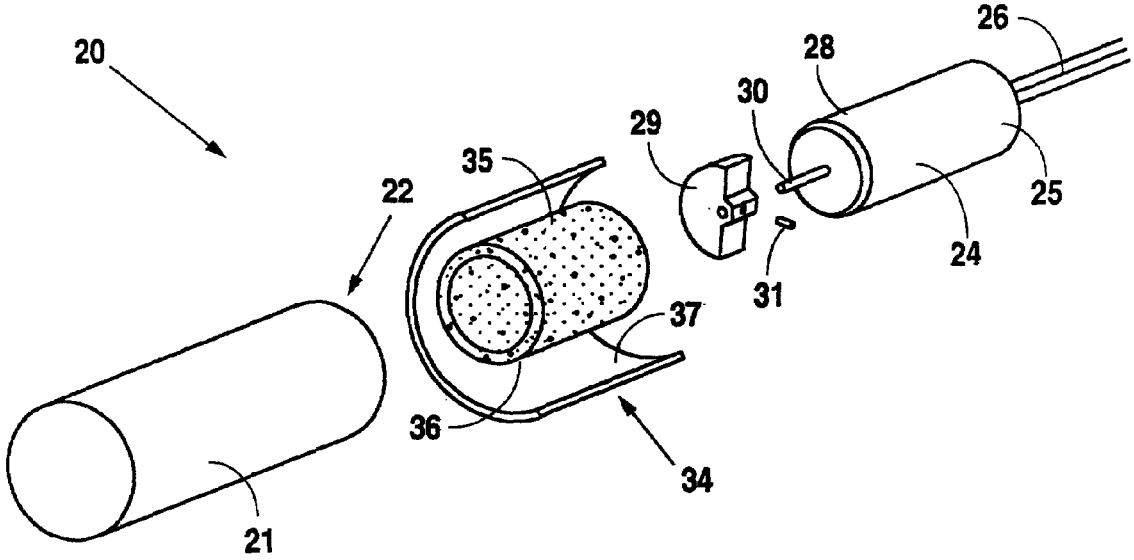
FIG. 1 shows, in an exploded perspective view, the preferred embodiment of the vibrating transducer of the present invention.
Figure 2:
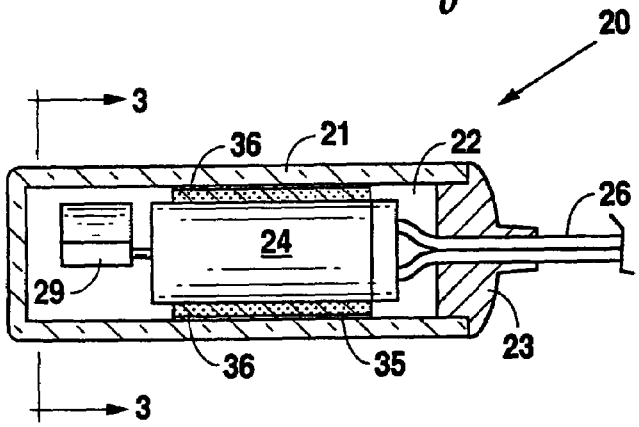
FIG. 2 shows, in a cross sectional side view, details of the arrangement of the internal components of the vibrating transducer of FIG. 1.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, and to FIGS. 1 through 4 in particular, the vibrating transducer 20 of the present invention is shown to generally comprise an electric motor 24 having attached thereto an eccentric weight 29 and encased within a rigid housing 21. As is typical with pager transducers and the like, operation of the electric motor 24 turns a shaft 30 upon which the eccentric weight 29 is mounted with, for example, a pin 31. As will be appreciated by those of ordinary skill in the art, rotation upon the shaft 30 of the eccentric weight 29 produces a vibratory effect upon the motor 24 resulting from the forward portion of the motor attempting to shift laterally outward from the nominal axis of rotation 32 of the shaft 30, as depicted by the centrifugal force lines F in FIG. 4.

In typical implementations of this principle, the electric motor is rigidly fixed to some body such as, for example, a pager or cellular telephone housing with mounting clamps, brackets or the like. In the present invention, however, unlike the vibrating transducers of the prior art, the electric motor 24 is encased within a rigid housing 21 by the provision of a flexible motor mount 34, which allows the forward portion 28 of the electric motor 24 to generally wobble within the rigid housing 21 as the eccentric weight 29 is rotated upon the motor shaft 30. In this manner, the resultant forces F are the product of much greater momentum in the eccentric weight 29 than that obtained in the fixed configuration of the prior art.

In the preferred embodiment of the present invention, as detailed in FIGS. 1 through 4, the flexible motor mount 34 generally comprises a wrapping of preferably foam cushion material 35, which is sized and shaped to snuggly fill the space provided between the electric motor 24 and the interior of the rigid housing 21. To facilitate manufacture of the vibrating transducer 20, as generally depicted in FIG. 1, the foam cushion 35 may be held in place about the body of the electric motor 34 with a cushion securing sheet 37, which may comprise a thin paper glued in place about the cushion 35, thin adhesive tape or any substantially equivalent means. To complete the manufacture of the vibrating transducer 20, the cushioned electric motor 24, with eccentric weight 29 attached to its shaft 30, is inserted into the rigid housing 21 and secured in place by the application of epoxy 23 into the open, rear portion 22 of the housing 21. As will be understood by those of ordinary skill in the art, the epoxy 23 also serves to stabilize the power cord 26 to the electric motor 24, thereby preventing accidental disengagement of the power cord 26 from the electric motor 24.

Figure 3:
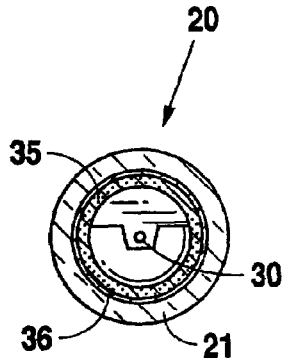
FIG. 3 shows, in a cross sectional end view taken through cut line 3-3 of FIG. 2, additional details of the arrangement of the internal components of the vibrating transducer of FIG. 1.
Figure 4:
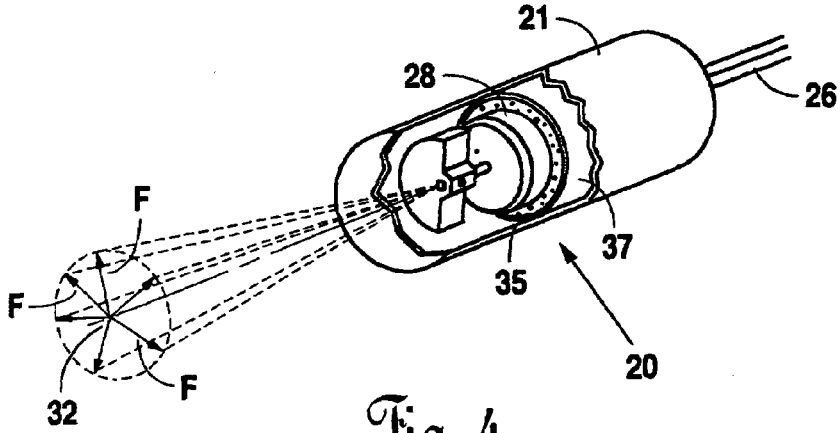
FIG. 4 shows, in a partially cut away perspective view, a representation of the forces produced in the operation of the vibrating transducer of FIG. 1.
Figure 5A:
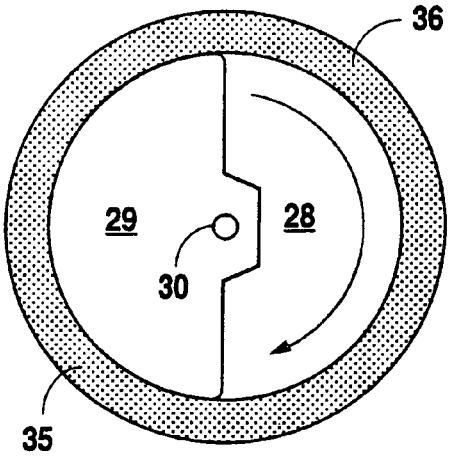
FIGS. 5A through 5F show, in schematic representations generally corresponding to the view of FIG. 3, changes in the relative positions of various internal components of the vibrating transducer of FIG. 1, which changes occur as a result of the operational forces represented in FIG. 4.
Figure 5B:
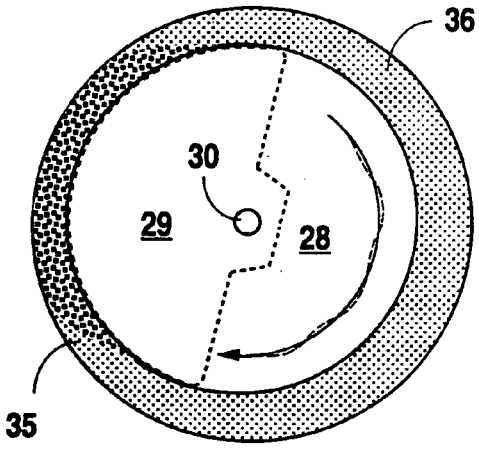
Figure 5C:
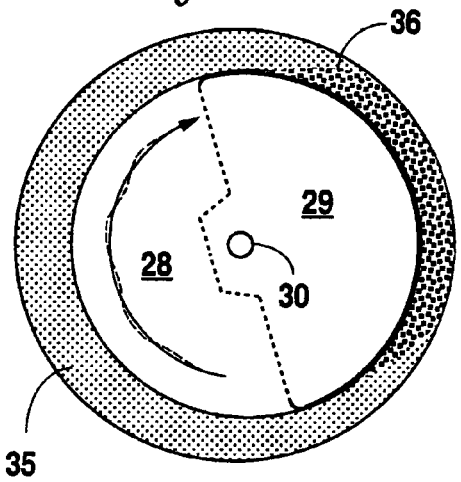
Figure 5D:
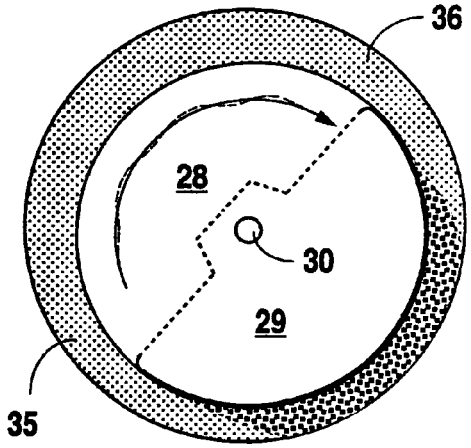
Figure 5E:
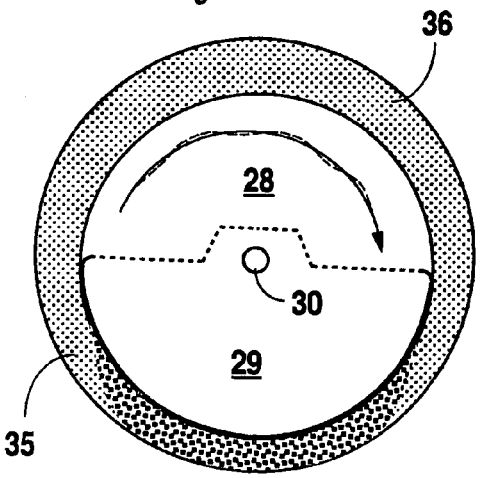
Figure 5F:
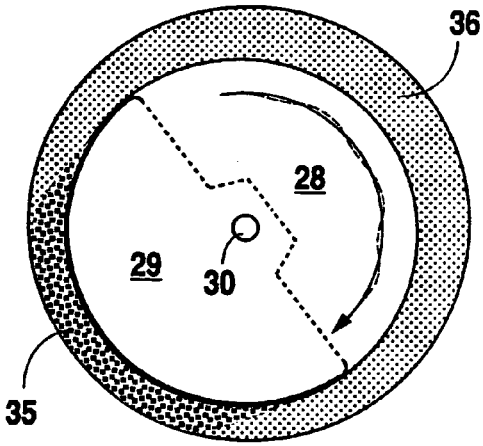

Referring now to FIGS. 3 through 5, the enhanced operation of the vibrating transducer 20 of the present invention is detailed. At the outset, however, it is noted that in order to obtain maximum benefit of the present invention, the rigid housing 21 is provided in a generally cylindrical shape, as will be better understood further herein. In any case, as shown in the cross sectional view of FIG. 3, and corresponding views of FIGS. 5A through 5F, the forward portion 28 of the electric motor 24 is encompassed by the forward portion 36 of the foam cushion 35. At rest, i.e. without the electric motor 24 in operation, the electric motor 24 is substantially uniformly surrounded by the foam cushion 35, as shown in FIG. 5A.

Upon actuation of the electric motor 24, however, the centrifugal forces F generated by the outward throw of the eccentric weight 29 causes the axis of rotation 32 of the motor's shaft 30 to follow a conical pattern, as depicted in FIG. 4. As a result, the forward portion 28 of the electric motor 28 is thrown into the forward portion 36 of the foam cushion 35, depressing the area of cushion 35 adjacent the eccentric weight 29 and allowing expansion of the portion of the cushion 35 generally opposite, as depicted in FIGS. 5B through 5F corresponding to various rotational positions of the eccentric weight 29.

As is evident through reference to FIGS. 5B through 5F, the cooperative arrangement of the cushion 35 about the electric motor 24, as also enhanced by the cylindrical shape of the rigid housing 21, allows the eccentric weight 29 to build greater momentum than possible in embodiments where the motor is rigidly affixed to a body. As the forward portion 36 of the foam cushion 35 compresses under the centrifugal forces F of the eccentric weight 29, however, a point is reached where the foam cushion 35 is no longer compressible against the interior wall of the rigid housing 21 and the forward portion 28 of the electric motor 24 is repelled away from the interior wall toward the opposite portion of interior wall.

The result, is a vibratory effect much more pronounced than that obtained in prior art configurations calling for the rigid affixation of an electric motor to a housing. Additionally, Applicant has found that the resulting pronounced vibratory effect is generally more perceptible to the human sense of touch than is that produced by prior art configurations. In particular, small differences on the order of tens of milliseconds or less in duration of operation of the vibrating transducer 20 of the present invention, i.e. duration of powering of the electric motor 24, are easily perceived and differentiated. As a result, the vibrating transducer 20 of the present invention is particularly adapted for applications requiring differentiation of multiple tactile stimulations such as, for example, the transmission of Morse code or other signaling systems, implementation of tactile metronomes with distinct tactile stimuli representing downbeats versus divisional beats, implementations of sports training devices used to reinforce rhythms and/or timing of motions or the like.

Figure 6:
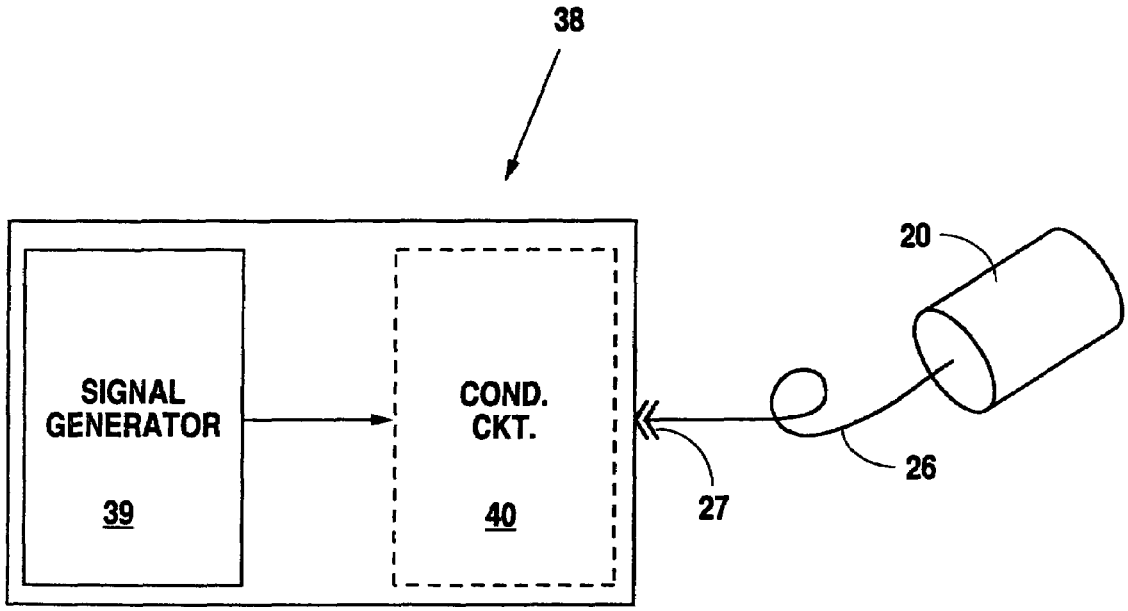
FIG. 6 shows, in a functional block diagram, one embodiment of a system for employing the vibrating transducer of FIG. 1.

Referring now to FIG. 6, a representative tactile stimulation system 38 employing the foregoing improvements is shown to generally comprise a signal generator 39 in electrical communication with the vibrating transducer 20 of the present invention. As will be appreciated by those of ordinary skill in the art, the signal generator 39 may take any of a variety of forms, but in any case is adapted to generate a driving signal for the vibrating transducer 20 in whatever tempo, duration, complex rhythm or the like is appropriate for the application for which the vibrating transducer 20 is to be utilized. Additionally, a signal conditioning circuit 40 may be implemented whereby a single implementation of the vibrating transducer 20 may be made compatible with a plurality of signal generators 39 having widely diverse electrical output characteristics.

Figures 7A, 7B:
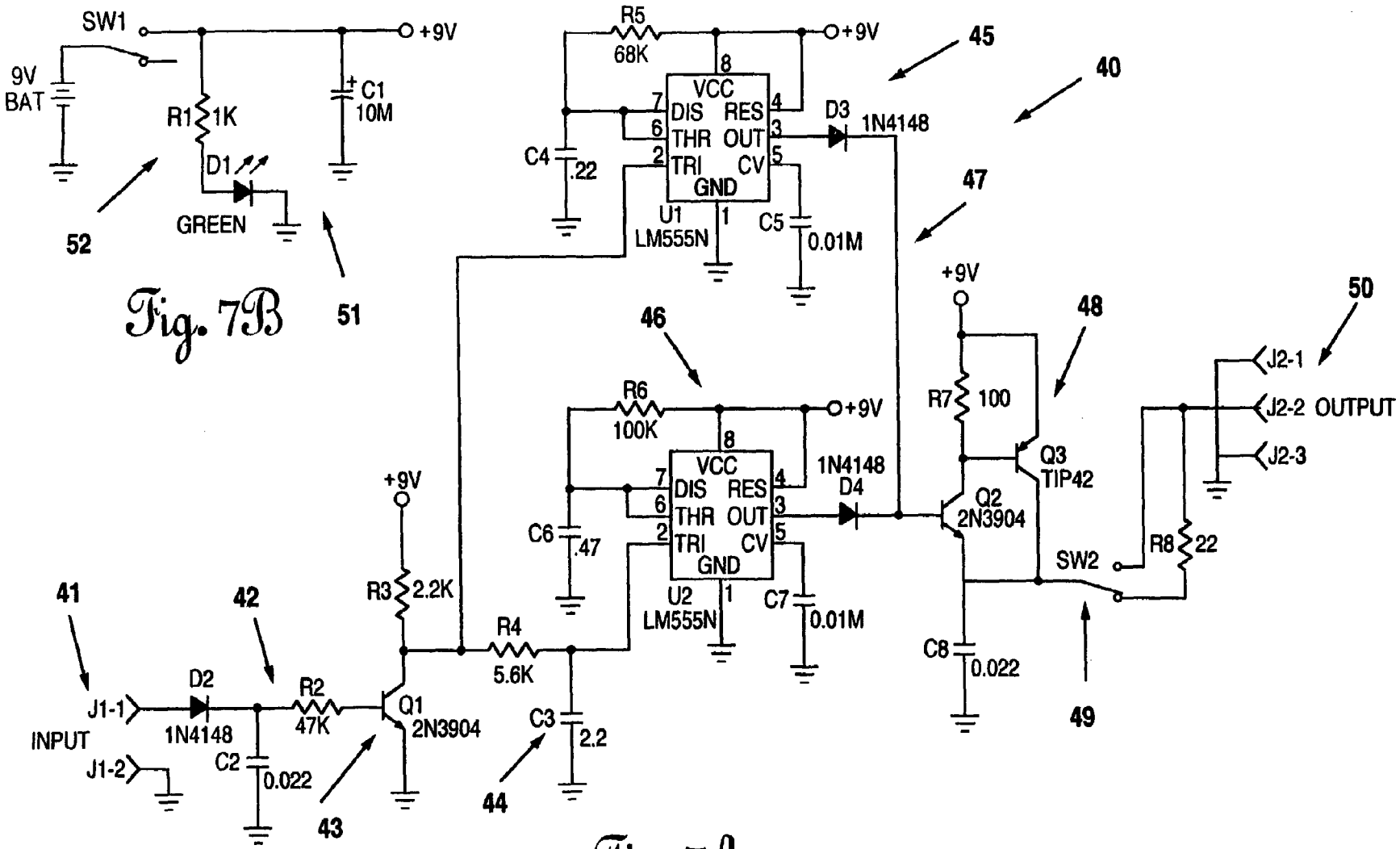
FIGS. 7A and 7B show, in schematic diagrams, exemplary electronic circuits such as may be utilized (if necessary) in the system of FIG. 6 for conditioning signal generator output signals for driving the vibrating transducer of FIG. 1.

As shown in FIG. 7A, such a signal conditioning circuit 40 particularly includes an output amplifier 48 with the capability to provide the necessary current for operation of the motor 24 of the vibrating transducer 20 and preferably comprises a power conditioning circuit 51, as shown in FIG. 7B, having the capability to prevent and/or suppress voltage spiking, such as may be expected in response to the highly inductive load typical of the type of electric motor 24 utilized in the implementation of the vibrating transducer 20. Additionally, the signal conditioning circuit 40 preferably comprises one or more provisions for accepting input signals of varying electrical characteristics. For example, the conditioning circuit 40 of FIG. 7A includes an envelope detector 42, which, as is known to those of ordinary skill in the art, is capable of accepting a burst of voltage pulses as if the burst were a single pulse having the same time duration as the burst or, without different result, accepting a single pulse of the same time duration as the burst; at the output of the envelope detector 42, the signals from each will be largely indistinguishable.

Although those of ordinary skill in the art will recognize that lesser, or in some cases no, signal conditioning circuit may be required depending upon the electrical characteristics of the signals output from the signal generator 39, an exemplary only signal conditioning circuit 40 is shown in FIG. 7A to generally comprise an input jack 41 for receiving signals from the signal generator 39; an envelope detector 42 for transforming various types of input signals into a common characteristic pulse train wherein the time duration of each pulse dictates the output of the vibrating transducer 20; an input amplifier 43 for squaring the output of the envelope detector for further processing; a first signal generator 45 for generating "moderate intensity" or short duration outputs from the vibrating transducer 20 and a second signal generator 46 for generating "intense" or long duration outputs from the vibrating transducer 20; an output amplifier 48 for providing necessary current for operation of the electric motor 24 of the vibrating transducer 20; an output jack 50 for connection, through a power cord jack 27, of the power cord 26 leading to the motor 24 of the vibrating transducer 20; and other circuitry in support of the foregoing operations and/or for providing additional features, as will be better understood further herein.

Looking closer at the signal conditioning circuit 40 depicted in FIG. 7A, the envelope detector 42 is shown to comprise a 1N4148 diode D2, having its anode connected to terminal J1-1 of input jack 41, and a 0.022 μF capacitor C2 tying the cathode of diode D2 to ground. Signals input at terminal J1-1 of input jack 41 feed into the anode of diode D2 and the envelope of those signals are output at the cathode of diode D2. In order to produce cleaner, more square representations of the resulting signal envelope, facilitating further processing of the input signals, the envelope signal from the envelope detector 42 is passed through an input amplifier 43, which comprises a 2N3904 NPN BJT transistor Q1 configured as a common emitter amplifier in Class C operation. A 47 kΩ resistor R2 is selected to limit the current through the base-emitter junction of transistor Q1 and to raise the input impedance of the amplifier 43 to a level that will not load down the input envelope signal. A 2.2 kΩ resistor R3 is selected to operate the amplifier 43 in saturation, resulting in a squared off, amplified output at the collector of transistor Q1.

In the next stage of the signal conditioning circuit 40, a pair of signal generators 45, 46 is provided for producing drive signals for operation of the electric motor 24 of the vibrating transducer 20. Each signal generator 45, 46 comprises an LM555N CMOS timer U1, U2, respectively, configured as a monostable multivibrator or "one-shot." As shown in the figure, the output timing circuit of the first CMOS timer U1 comprises a 68 kΩ resistor R5 and a 0.22 μF capacitor C4 in order to produce a short duration output signal at pin 3 of the CMOS timer U1 of about 10 milliseconds. Upon delivery of the output signal to the electric motor 24 of the vibrating transducer 20, a moderate intensity (or short) tactile sensation will be produced. The output timing circuit of the second CMOS timer U2, on the other hand, comprises a 100 kΩ resistor R6 and a 0.47 μF capacitor C6 such that the output signal generated at pin 3 of the second CMOS timer U2 is approximately 40 milliseconds in duration, which when delivered to the electric motor 24 the vibrating transducer 20 will produce a distinctly more intense (or long) tactile sensation.

In order to differentiate between input signals, the amplified, envelope signal from the collector of transistor Q1, i.e., the output from the input amplifier 43, is delivered "as is" to the trigger pin 2 of the first CMOS timer U1, but is filtered through a first order R-C low pass filter 44 prior to delivery to the trigger pin 2 of the second CMOS timer U2. As will be appreciated by those of ordinary skill in the art, this prevents shorter duration input pulses or pulse streams from triggering the second monostable multivibrator signal generator 45. As also will be appreciated by those of ordinary skill in the art, the required R-C filter 44 is readily implemented with a 5.6 kΩ series resistor and 2.2 μF capacitor to ground.

The output (from pin 3 of CMOS timer U1) of the first monostable multivibrator signal generator 45 and the output (from pin 3 of CMOS timer U2) of the second monostable multivibrator signal generator 46 are then combined through a solid state OR circuit comprising a pair of 1N4148 diodes D3, D4 having their cathodes tied together. In this manner, either the presence of a signal from the first signal generator 45 at the anode of the first diode D3 or the presence of a signal from the second signal generator 46 at the anode of the second diode D4 will result in the presence of a signal at the common cathodes of the diodes D3, D4, which is then fed into the output amplifier 48.

While many of the foregoing features of the signal conditioning circuit 40 as thus far described may not be required in every implementation of the present invention, the output amplifier 48, or its substantial equivalent, will generally be required for any implementation in which logical level signals will be expected to drive the electric motor 24 of the vibrating transducer 20, which will generally have a current requirement beyond the capabilities of most solid state components.

A shown in FIG. 7A, an exemplary output amplifier 48 comprises a 2N3904 NPN BJT transistor Q2, configured as an emitter follower, coupled with a TIP42 high current PNP transistor Q3 in a TO-220 heat dissipating package, for providing the necessary current for operation of the electric motor 24 of the vibrating transducer 20. As will be recognized by those of ordinary skill in the art, the output amplifier 48 as shown may be considered a two stage, high current emitter follower.

In any case, the output from the output amplifier 48 is fed through an output power level selector 49 to an output jack 50, into which the power cord jack 27 to the electric motor 24 of the vibrating transducer 20 may be plugged. As shown in FIG. 7A, the output power level selector 49 preferably comprises a 22Ω resistor R8, which is selectively placed in series with the output circuit by selecting the appropriate position of a single pole, single throw switch SW2. Although Applicant has found that 22Ω is an appropriate value for the resistor R8, it is noted that the value is selected empirically in order to obtain the user desired tactile feel for the "low" output selection. Additionally, those of ordinary skill in the art will recognize that the resistor R8 may be replaced with a potentiometer, thereby providing a fully adjustable output power level.

Finally, as previously discussed, a power conditioning circuit 51, such as that which is shown in FIG. 7B, is preferably provided to prevent and/or suppress voltage spiking, such as may be expected in response to the highly inductive load typical of the type of electric motor 24 utilized in the implementation of the vibrating transducer 20. A shown in FIG. 7B, the power conditioning circuit comprises a 10 μF electrolytic capacitor C1 tying to ground the 9-V power bus from, for example, a 9-V battery BAT. As will be recognized by those of ordinary skill in the art, the electrolytic capacitor C1 will temporarily supply additional current to the 9-V bus as may be required to compensate for transients resulting from the draw upon the output amplifier 48 caused during startup of the electric motor 24 of the vibrating transducer 20. Additionally, the power conditioning circuit preferably comprises an ON-OFF switch SW1 and may also include a power on indicator 52. As will be appreciated by those of ordinary skill in the art, such a power on indicator may be readily implemented with a 1 kΩ current limiting resistor R1 in series with a light emitting diode ("LED") D1 between the 9-V power bus and ground.

Referring now to the figures generally, and to FIGS. 8 through 11 in particular, the operation of the vibrating transducer 20 of the present invention is detailed. For purposes of this exemplary discussion, it is assumed that the vibrating transducer 20 is to be used in an application requiring the differentiation of two distinct tactile stimulations. It should be recognized, however, that the vibrating transducer 20 of the present invention is readily capable of being used in applications requiring more. Still further, especially in light of this exemplary disclosure, those of ordinary skill in the art will readily recognize the necessary modifications of the previously described circuits as may be required for the implementation of higher order systems.

Figure 8A:
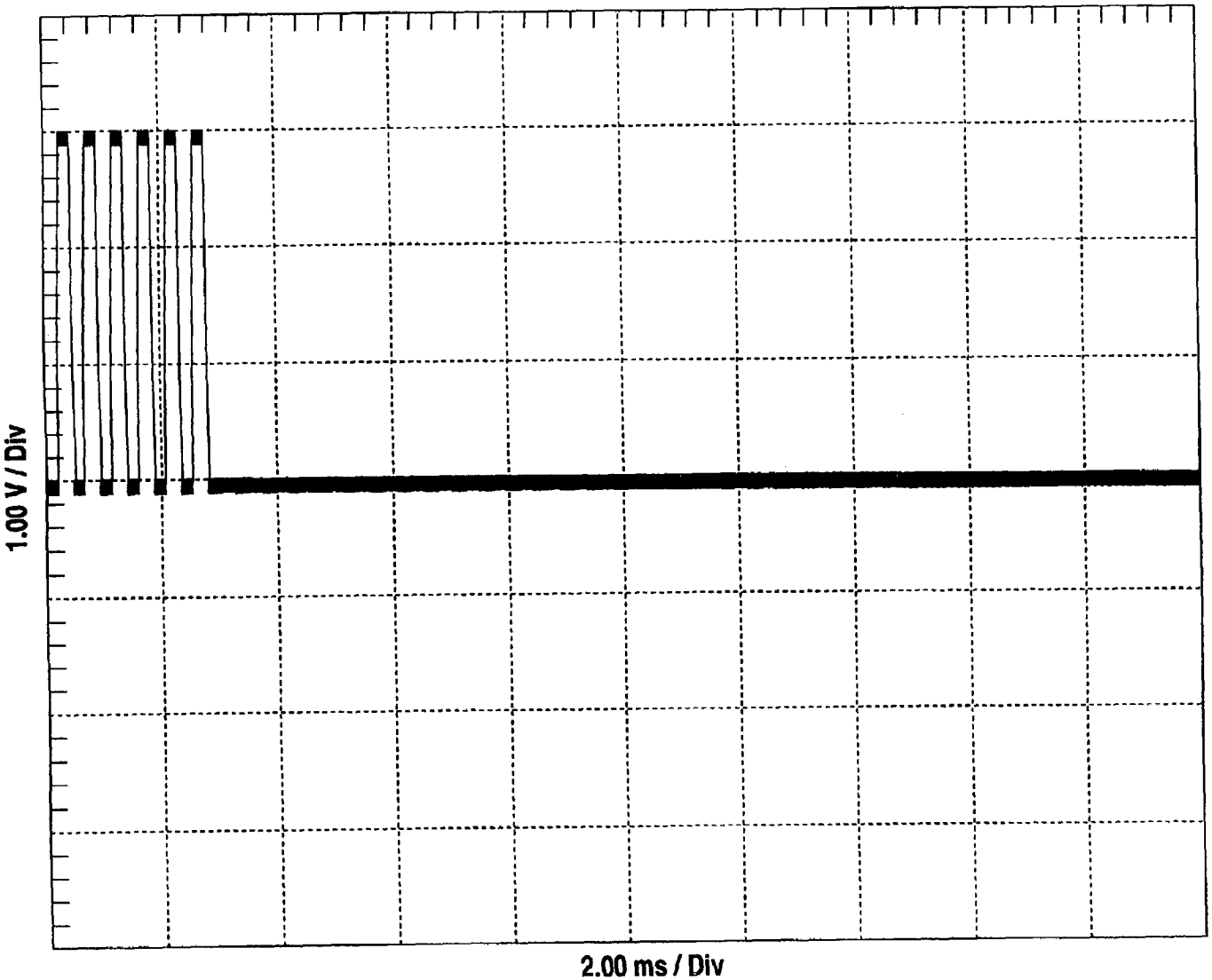
Figure 8B:
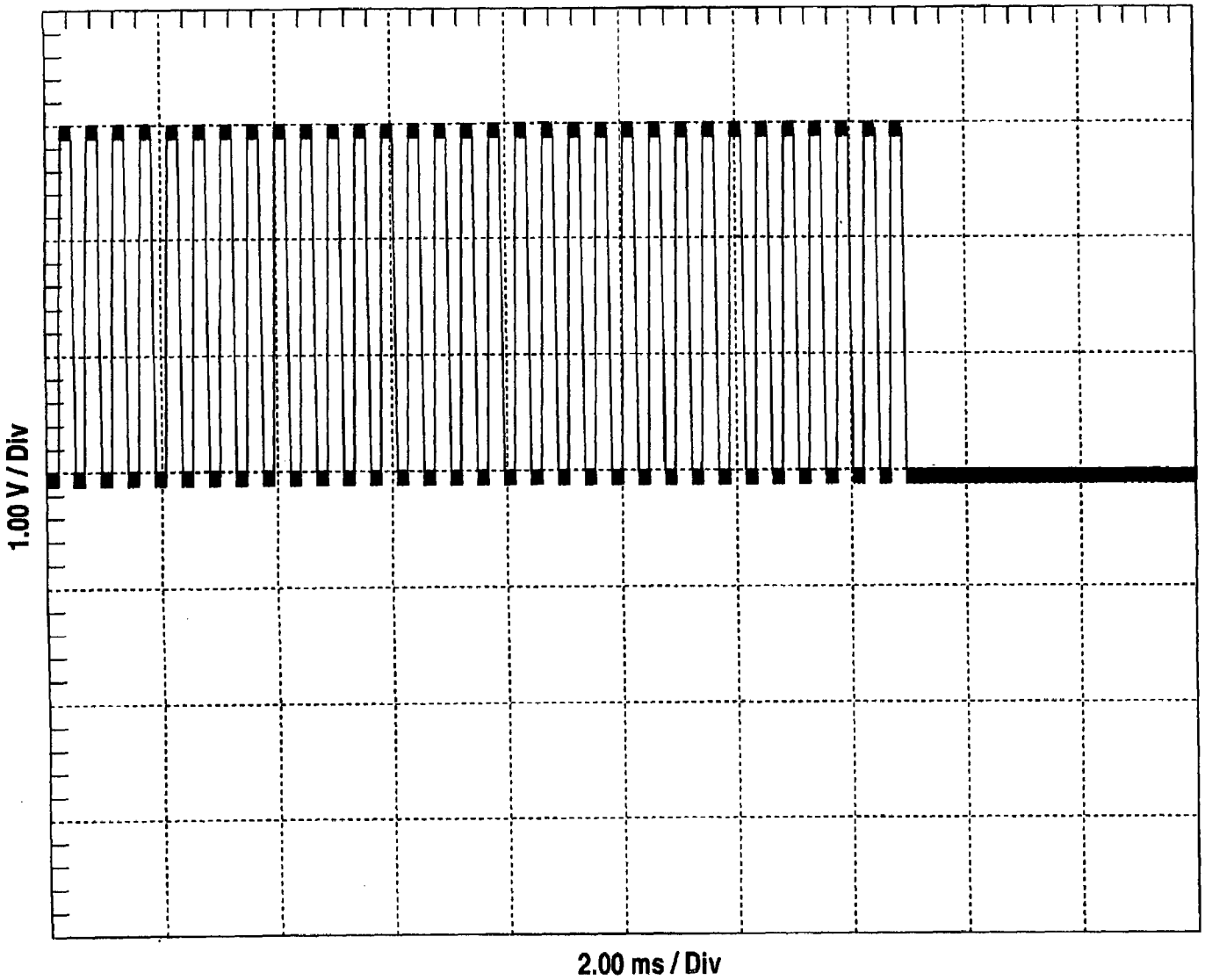

In any case, FIGS. 8A and 8B depict, in voltage time plots, representative input signals as may be produced by a signal generator 39 such as that shown in FIG. 6. In particular, FIG. 8A shows a "short" pulse train, approximately 3 milliseconds in duration. This pulse train may be generated by the signal generator 39 to represent a first event. Likewise, FIG. 8B shows a "long" pulse train, of approximately 15 milliseconds in duration, such as also may be generated by the signal generator 39 of FIG. 6. This latter pulse train may be generated to represent a second event. In operation of the vibrating transducer 20 of the present invention utilizing the signal conditioning circuit 40 of FIG. 7A, the pulse trains of FIGS. 8A and 8B will be fed in a desired pattern into the input jack 41 of the of the conditioning circuit 40 at terminal J1-1. For example, the pulse trains may be fed in the pattern SHORT-LONG-SHORT-SHORT-SHORT-LONG.

Figure 9B:
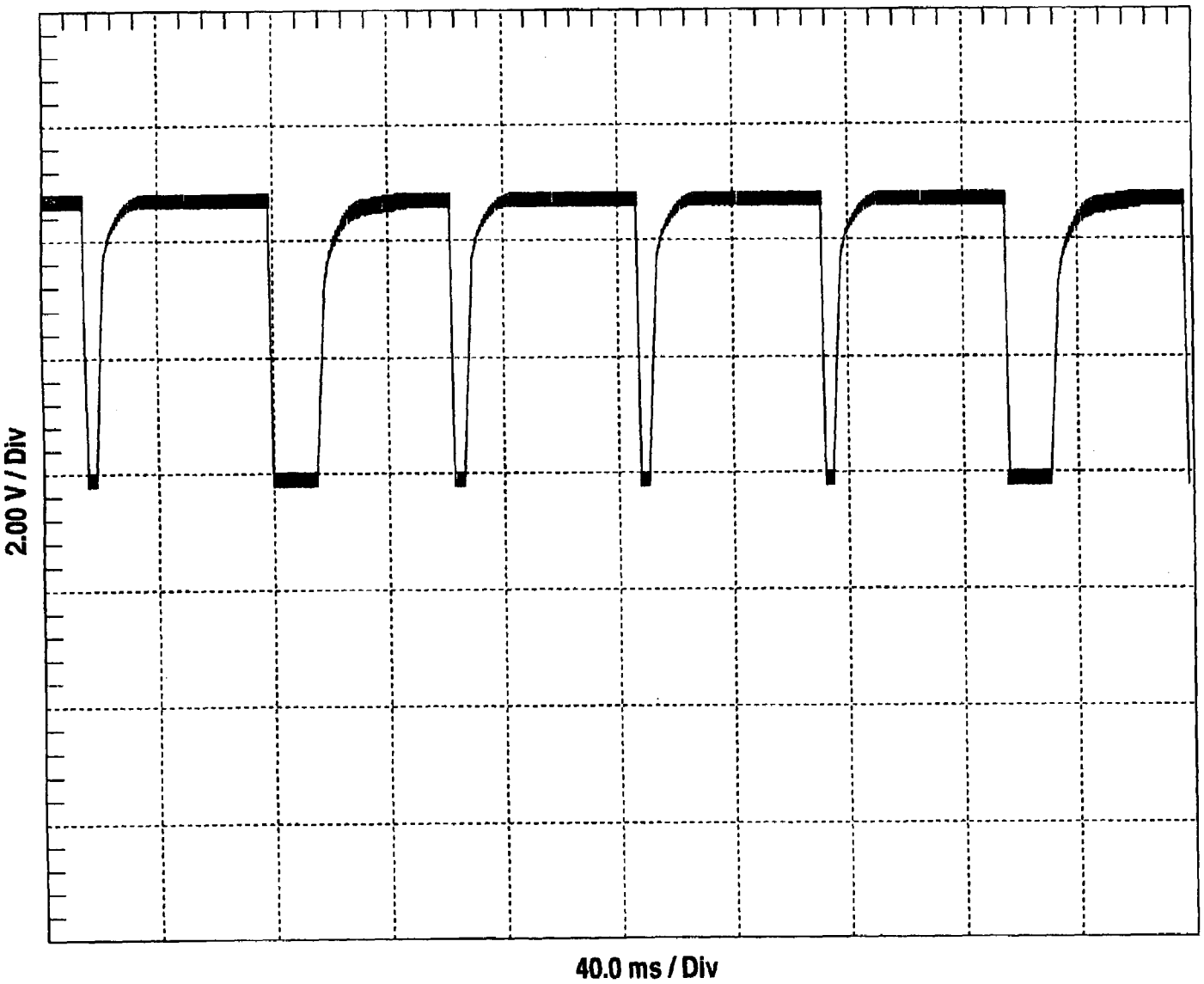
FIG. 9B shows, in a voltage time plot, the same composite signal after further being passed through a class C amplifier, as also implemented in the design of FIG. 7A.
Figure 9B:
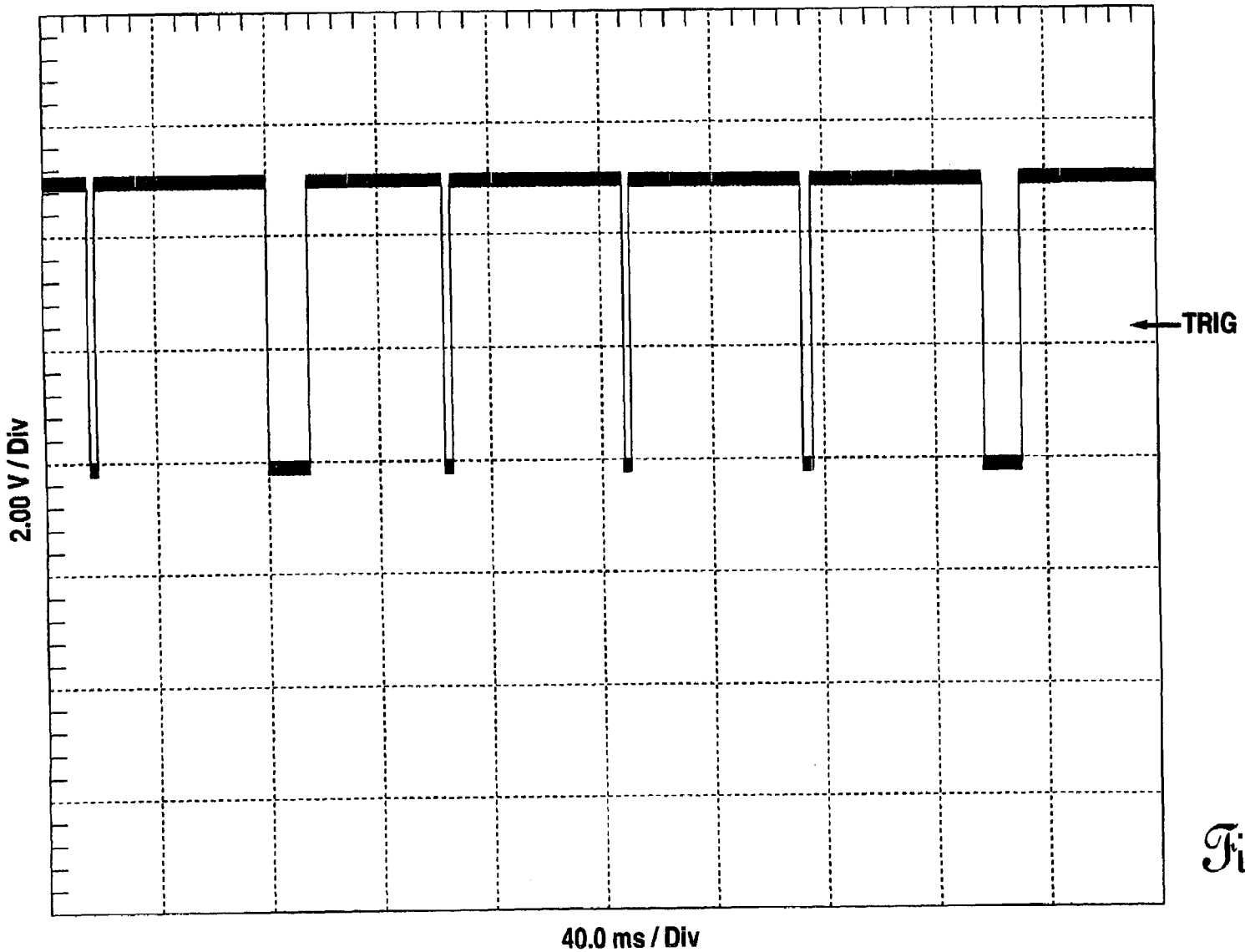

As previously described, the conditioning circuit 40 first produces the envelope of the input signal. Continuing with the example as set up, then, the output of the envelope detector 42 will be as depicted in the voltage time plot of FIG. 9A representing the signal obtained at the cathode of diode D2. As shown in the plot of FIG. 9A, however, the output of the envelope detector 42 will generally reflect effects of the time constant of its capacitor C2, resulting in roll off in the waveform. In order to produce a cleaner, more square waveform (and thus more readily utilizable for controlling timing operations), the output of the envelope detector 42 is preferably passed through an input amplifier 43 configured to operate in Class C, or saturation. As depicted in FIG. 9B, representing the voltage waveform at the collector of the transistor Q1 forming the input amplifier 43, the output of the input amplifier 43 is a series of generally squared pulses. In any case, those of ordinary skill in the art will recognize that the input signal pattern SHORT-LONG-SHORT-SHORT-SHORT-LONG is at this point still preserved.

Figure 10:
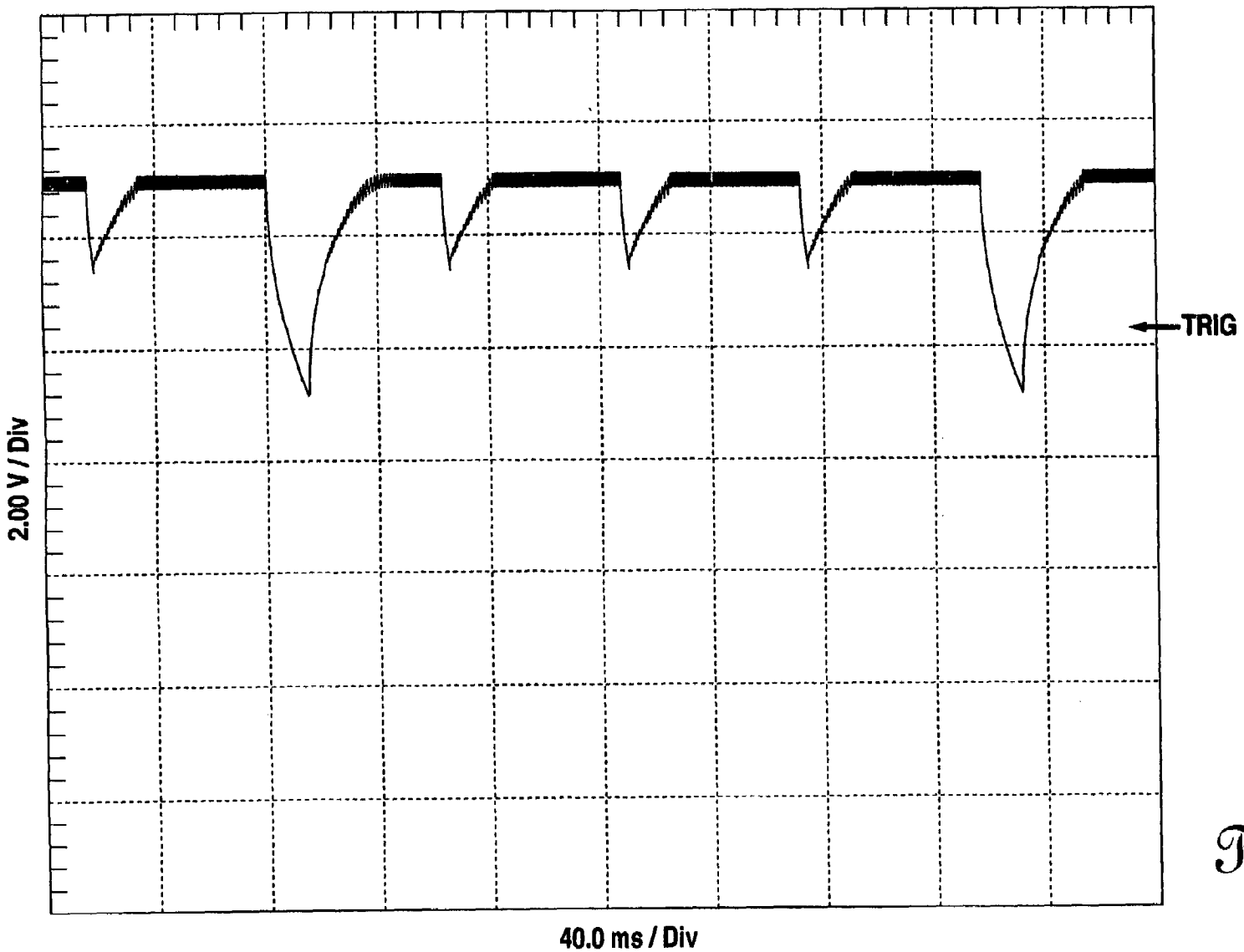
FIG. 10 shows, in a voltage time plot, the signal of FIG. 9B after being low pass filtered by a first order R-C filter, as implemented in the design of FIG. 7A.
Figure 11B:
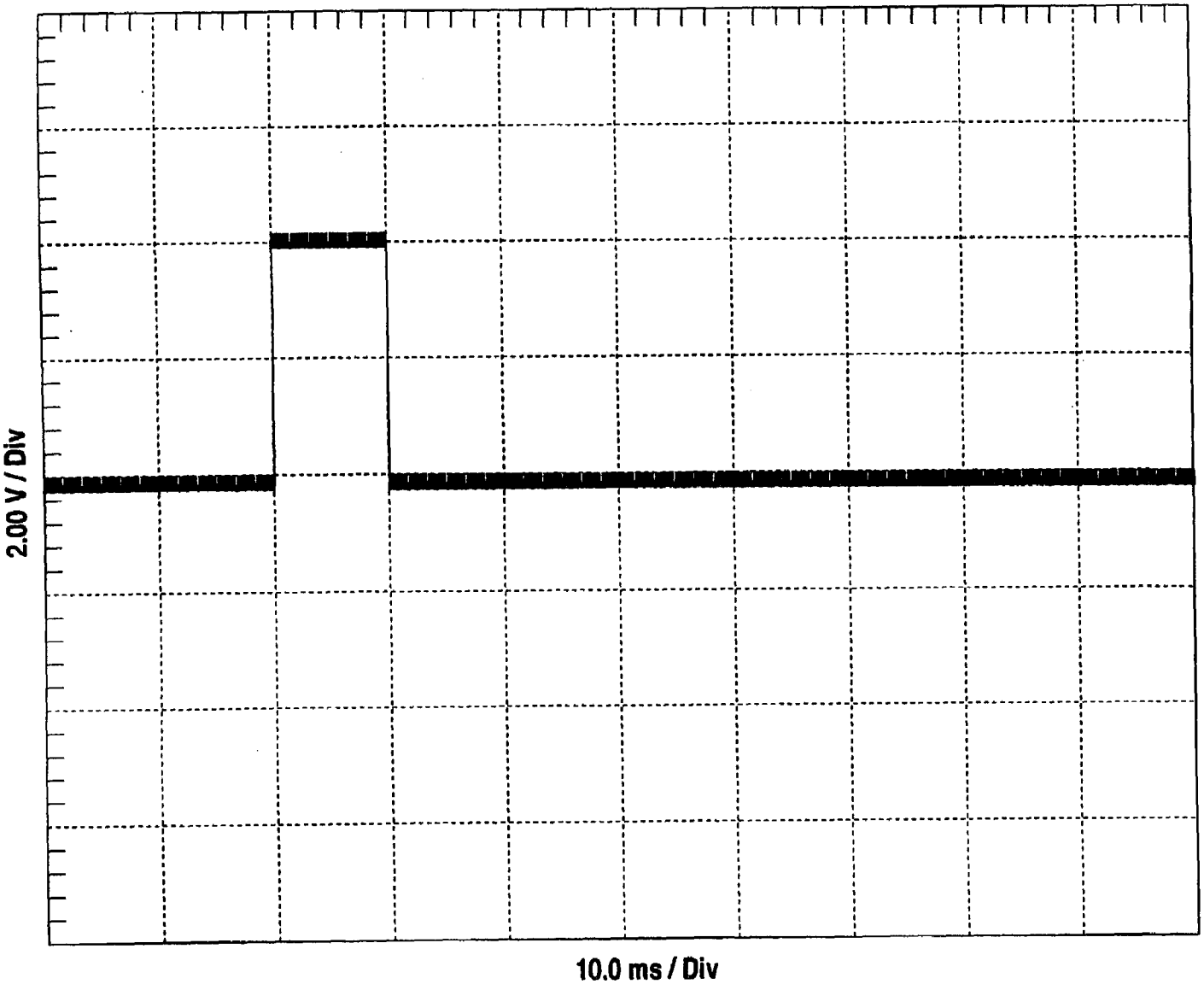
Figure 11B:
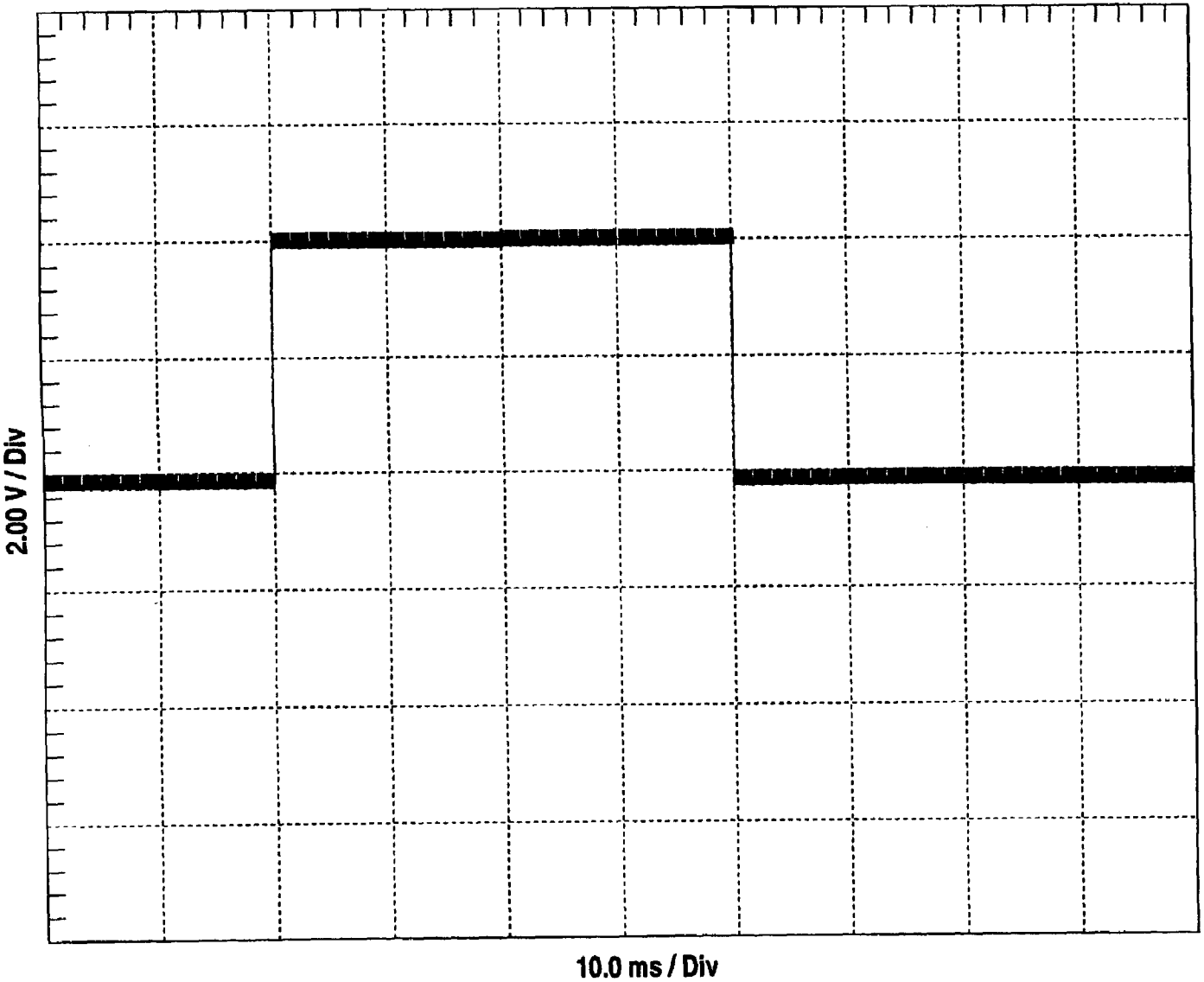

As also previously discussed, the next stage of the conditioning circuit 40 comprises a pair of monostable multivibrator, or "one-shot," signal generators 45, 46. The amplified signal depicted in FIG. 9B is fed directly into the trigger pin 2 of the CMOS timer U1 of the first signal generator 45. As will be understood by those of ordinary skill in the art, each pulse of the input signal crossing the threshold trigger level, shown as TRIG on FIG. 9B, will trigger the first timer U1, causing an approximately 10 millisecond pulse, as depicted in FIG. 11A, to be output from pin 3 of the timer U1. It is desired, however, that only the longer pulses trigger the CMOS timer U2 of the second signal generator 46. To effect this result, then, the amplified signal of FIG. 9B is first passed through a low pass filter 44 prior to application to the trigger pin 2 of the CMOS timer U2 of the second signal generator 46. As is evident from the depiction of FIG. 10, representing the filtered signal output from the low pass filter 44, only the longer duration pulses are of low enough frequency to sufficiently pass the filter 44 to cross the threshold level as indicated on FIG. 10 as TRIG. As a result, when this waveform is fed into the trigger pin 2 of the CMOS timer U2 of the second signal generator 46, only the longer pulses cause the generation of the approximately 40 millisecond pulse, as depicted in FIG. 11B, at the output pin 3 of the CMOS timer U2 of the second signal generator 46.

The pulse trains thus generated by the pair of monostable multivibrator, or "one-shot," signal generators 45, 46 is are then combined by the solid state OR circuit 47 depicted in FIG. 7A. Upon combination, as will be apparent to those of ordinary skill in the art, the following voltage pattern will be present at the input to the output amplifier 48: $V_{10ms}$-Pause-$V_{40ms}$-Pause-$V_{10ms}$-Pause-$V_{10ms}$-Pause-$V_{10ms}$-Pause-$V_{40ms}$, representing a series of 40 millisecond duration and 10 millisecond duration pulses of voltage in the SHORT-LONG-SHORT-SHORT-SHORT-LONG pattern of the input signal. These voltages are then passed through the output amplifier 48, which provides sufficient current for operation of the motor 24 of the vibrating transducer 20, and then passed to motor 24 of the vibrating transducer 20, which is turned on for 10 milliseconds, turned off, turned on for 40 milliseconds, turned off, turned on for 10 milliseconds, turned off, turned on for 10 milliseconds, turned off, turned on for 10 milliseconds, turned off, and then turned on for 40 milliseconds. As has been found by Applicant, the input signal pattern is readily perceived through the vibrating transducer 20.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A vibrating transducer apparatus for producing multiple discrete, differentiable tactile stimulations to provide rhythmic guidance to a person in contact with the apparatus, the apparatus comprising:

an electric motor having a shaft;

a rigid housing enclosing the electric motor;

an eccentric weight attached to the electric motor shaft;

a flexible motor mount supporting the electric motor within the rigid housing, the motor mount being adapted to enable the motor, when energized, to wobble within the rigid housing, thereby enhancing the intensity of the vibratory tactile stimulations produced; and a driver circuit for facilitating operation of the electric motor, the driver circuit adapted to energize the motor to produce a rhythmic pattern of discrete tactile stimulations, the pattern including at least two tactile stimulations that differ from each other in duration or intensity.

2. The apparatus of claim 1, wherein the rigid housing comprises a generally cylindrically shaped tube.

3. The apparatus of claim 1, further comprising:

a power supply for supplying power to the electric motor;

a second housing enclosing the power supply, wherein the second housing is structurally isolated from the rigid housing enclosing the electric motor, whereby vibrations from the rigid housing are not transmitted to, nor diminished by the second housing; and an electrical cable connecting the power supply to the electric motor.

4. The apparatus of claim 1, further comprising a digital input device to energize the motor according to a programmed rhythm.

5. A vibrating transducer apparatus for producing multiple discrete, readily differentiable tactile stimulations to provide rhythmic guidance to a person in contact with the apparatus, the vibrating transducer apparatus comprising:

an electric motor having a shaft;

a rigid housing enclosing the electric motor;

an eccentric weight attached to the electric motor shaft;

a compressible foam cushion encircling the electric motor within the rigid housing, so that the motor, when energized, is adapted to wobble within the rigid housing by compressing the foam at different points about the circumference of the motor as the eccentric weight turns; and a driver circuit for energizing the electric motor with a rhythmic pattern of discrete tactile stimulations, the pattern including at least two tactile stimulations that differ from each other in duration or intensity.

6. The vibrating transducer apparatus of claim 5, wherein the rigid housing composes a generally cylindrically shaped tube.

7. The vibrating transducer apparatus of claim 5, wherein the foam cushion is wrapped by a securing sheet.

8. The vibrating transducer apparatus of claim 5, wherein the driver circuit comprises a plurality of timing sub-circuits.

9. The vibrating transducer apparatus of claim 8, wherein each said timing sub-circuit is adapted to operate said electric motor for a distinct period of time.

10. The vibrating transducer apparatus of claim 9, wherein:

each timing sub-circuit is activated by a trigger signal;

each trigger signal is derived from a single input signal; and wherein the trigger signals are differentiated by filtering of the input signal.

11. The vibrating transducer apparatus of claim 10, further comprising a digital signal generator for producing the input signal.

12. The vibrating transducer apparatus of claim 11, wherein the signal generator is adapted to produce pulse trains of differing time durations.

13. A vibrating transducer for producing multiple, readily differentiable tactile stimulations, said vibrating transducer comprising:

a rigid housing;

an electric motor enclosed within said rigid housing, said electric motor having attached thereto an eccentric weight; and a flexible motor mount comprising a cushion wrapped substantially about said electric motor, the flexible motor mount supporting the electric motor within said rigid housing;

wherein said cushion is wrapped by a securing sheet.

14. The vibrating transducer as recited in claim 13, wherein said securing sheet comprises a thin paper wrapping.

15. The vibrating transducer as recited in claim 13, wherein said securing sheet comprises adhesive tape.

16. A vibrating transducer for producing multiple, readily differentiable tactile stimulations, said vibrating transducer comprising:

a rigid housing;

an electric motor enclosed within said rigid housing, said electric motor having attached thereto an eccentric weight and being supported within said rigid housing by a flexible motor mount; and a driver circuit for facilitating operation of said electric motor;

wherein said driver circuit comprises a plurality of timing sub-circuits, and wherein each said timing sub-circuit comprises a monostable multivibrator.

* * * * *